US005810911A

United States Patent [19]

Behrendt et al.

[11] Patent Number: 5,810,911

[45] Date of Patent: Sep. 22, 1998

[54] FILTER DEVICE FOR AN AIR-MOVING HAIR CARE APPLIANCE

[75] Inventors: Jürgen Behrendt, Idstein; Hans-Jürgen Golob, Friedrichsdorf; Robert Jung, Friedberg; Wilfried Rolf, Runkel-Eschenau; Boris Wonka, Neu-Isenburg; Björn Kling, Frankfurt, all of Germany

[73] Assignee: Braun Aktiengesellschaft, Frankfurt, Germany

[21] Appl. No.: 754,442

[22] Filed: Nov. 21, 1996

[30] Foreign Application Priority Data

Sep. 5, 1996 [DE] Germany ..... 196 35 933.3

[51] Int. Cl.[6] ..... B01D 39/08; B01D 39/10; F26B 21/06

[52] U.S. Cl. ..... 95/278; 55/385.1; 55/505; 55/511; 55/525; 55/528; 34/97

[58] Field of Search ..... 55/385.1, 467, 55/495, 501, 505, 511, 528, 525; 34/82, 96, 97, 98; 392/383, 384, 385; 95/278, 282

[56] References Cited

U.S. PATENT DOCUMENTS

| | | | |
|---|---|---|---|
| 1,007,555 | 10/1911 | Gober | 55/505 |
| 1,250,451 | 12/1917 | Harrod | 55/505 |
| 2,410,522 | 11/1946 | Powell | 55/505 |
| 3,383,700 | 5/1968 | Taylor | 34/99 |
| 4,308,670 | 1/1982 | Bonnema | 34/97 |
| 4,683,369 | 7/1987 | Rieckman et al. | 392/385 |
| 4,896,020 | 1/1990 | Poweleit | 219/370 |
| 4,896,021 | 1/1990 | Poweleit et al. | 219/370 |
| 4,918,289 | 4/1990 | Ohlsen et al. | 219/370 |
| 5,112,374 | 5/1992 | Ackerman | 55/385.1 |
| 5,216,822 | 6/1993 | Madiedo | 34/82 |
| 5,312,467 | 5/1994 | Wolfe | 55/528 |
| 5,325,809 | 7/1994 | Mulle, Jr. | 116/70 |
| 5,331,748 | 7/1994 | Miller, Jr. | 34/97 |
| 5,394,620 | 3/1995 | Chimera | 34/98 |
| 5,433,017 | 9/1995 | Brauchli et al. | 34/82 |
| 5,448,677 | 9/1995 | Fell et al. | 392/383 |
| 5,490,336 | 2/1996 | Smick et al. | 34/97 |
| 5,526,578 | 6/1996 | Iyer | 34/97 |
| 5,608,975 | 3/1997 | Hsu | 34/97 |

FOREIGN PATENT DOCUMENTS

| | | | |
|---|---|---|---|
| 0 518 035 B1 | 12/1992 | European Pat. Off. . | |
| 79 21 427.0 | 4/1983 | Germany . | |
| 34 45 268 A1 | 6/1987 | Germany . | |
| 93 09 013.7 | 12/1994 | Germany . | |
| 38 02 638 C2 | 11/1995 | Germany . | |
| 2504975 | 6/1996 | Japan . | |
| 500125 | 2/1939 | United Kingdom | 34/97 |

OTHER PUBLICATIONS

SPILO catalog p. 30 "for sundries and much more" (undated prior art published prior to priority date).

*Primary Examiner*—C. Scott Bushey
*Attorney, Agent, or Firm*—Edward S. Podszus

[57] ABSTRACT

The invention is directed to a filter device (10) and to a method of cleaning such a filter device for an electrically powered air-moving hair-care appliance, in particular for a hair dryer, a hot-air curling brush or the like, with a filter element (12) having an inner and an outer side (25, 26), in which the inner side (25) of the filter element (12) is arranged in the area of an air entrance opening of the appliance. The filter element (12) is configured as a type of fabric, perforated foil or the like of small thickness, comprising in particular a screening fabric made of a plastic material. Further, the filter device (10) is configured in such manner that contaminants such as hair, fluff, dust or the like which are retained by the filter element (12) are substantially deposited on the outside of the filter element, and that the outside of the filter element is positioned on the hair-care appliance in a manner providing substantially free access to the user, and that contaminants are removed by the user simply wiping over the outer side (26) of the filter element (12).

71 Claims, 2 Drawing Sheets

FILTER DEVICE FOR AN AIR-MOVING HAIR CARE APPLIANCE

This invention relates to a filter device and to a method of cleaning such a filter device for an electrically powered air-moving hair-care appliance, in particular for a hair dryer, a hot-air curling brush or the like, with a filter element having an inner and an outer side, in which the inner side of the filter element is arranged in the area of an air entrance opening of the appliance.

A filter device of this type is known from EP 0 518 035 B1. This specification discloses a hair aspiration filter which is arranged between an air entrance grille fixedly attached to the appliance housing and a removable grille cap. The filter element itself is made of a fabric mat. To clean the filter element, it is first necessary to remove the grille cap and then to take out the filter element for cleaning or replacement. Filter devices for air-moving appliances, particularly for hair dryers, are intended to stop undesired contaminants such as, for example, hair, fluff, dust or the like from entering the interior of the hair dryer and hence to prevent soiling of and potential damage to the hair dryer.

In the case of the above mentioned filter devices for electrically powered air-moving appliances, particularly for hair dryers, it has shown that the necessary cleaning of the device by the user is either not performed regularly or it is neglected entirely. In the case of the appliance initially referred to which incorporates a removable filter element in accordance with EP 0 518 035 B1, experience indicates that the degree of contamination of the mat-type filter element is not always clearly identifiable by the user. However, severe contamination of the filter element results in a disadvantageously higher thermal loading of the hair dryer, which may lead to the appliance being switched off or damaged. The cleaning of the filter element is thus capable of improvement, because first the grille cap has to be dismantled and the filter element removed and then cleaned. Furthermore, cleaning is aggravated by an irregular structure of the mat-type filter element because predominantly hair, fluff and dust become lodged or trapped in the filter element. Although wet cleaning of the filter element is possible, this requires proper drying before the filter element is reinstalled by the user.

Other filter devices that are not covered by a grille cap conventionally display a structure which may well prevent fluff and hair from entering the interior of the hair dryer but this fluff and hair can be removed by the user only with difficulty. Furthermore, because the outer appearance of a hair dryer both with and without a filter is nearly identical, many users omit to put the filter element, after its unsatisfactory cleaning, back on the air entrance opening of the dryer, using the hair dryer without a filter thereafter. It is inevitable therefore that hair, fluff or dust will get into the hair dryer disadvantageously, resulting in a soiled, overheated or damaged appliance after a certain period of operation.

It is therefore an object of the present invention to provide a filter device for an electrically powered air-moving hair-care appliance, in particular for a hair dryer, which firstly includes a soiling indicator and warns the user to clean the filter device at the earliest possible moment. Further, the filter device is to be configured in such a way as to make its actual cleaning easy for the user to carry out.

SUMMARY OF THE INVENTION

According to the present invention, this object is accomplished in a filter device of the type described in the foregoing by the providing for the filter element to be configured as a type of fabric, perforated foil or the like of relatively small thickness, and for contaminants such as hair, fluff or dust which are retained by the filter element to be substantially deposited on the outside of the filter element, and for the outside of the filter element to be positioned on the hair-care appliance in a manner providing substantially free access to the user.

With a filter device of this type, it has proven to be advantageous that a major portion of the contaminants detaches on its own from the filter element after the appliance is switched off, particularly after the fan motor is switched off, firstly because of the condition of the filter element's surface structure according to the present invention, and secondly because the outside of the filter element is substantially freely accessible. The formation of a compartment on the outside of the filter element, such as is known from prior art appliances and which results in accumulations of hair and fluff in the compartments formed by the air entrance grille, is advantageously avoided. Any contaminants remaining on the filter element, such as hair and fluff, can be seen by the user directly after they collect and can be removed from the filter element by wiping over the outside of the filter element, for example, with the user's bare hand. Advantageously, there is thus no need of an additional soiling indicator. Each time the hair dryer is used, the user sees immediately and clearly the filter's current degree of soiling and is reminded accordingly to clean the filter element regularly.

In a particularly advantageous further configuration of the present invention, the filter element is configured as a screening fabric comprising threads of an in particular round area of cross-section. This results on the one hand in a flow-promoting cross-section of the fabric threads, and on the other hand in an easy removal of contaminants from the filter element or screening fabric without the contaminants having a chance to become trapped in the filter element.

In a further configuration of the filter element, it is proposed manufacturing the screening fabric from a thermoplastic material such as, for example, polypropylene or polyacrylics. The use of polyester (PES), which is a very easy-care, tear-resistant and non-hygroscopic material, has proven to be particularly advantageous.

In another further configuration, the screening fabric has a mesh width to thread diameter ratio of between 80 $\mu$m to 55 $\mu$m and 1200 $\mu$m to 400 $\mu$m, approximately, with an advantageous cleaning of the filter element having been accomplished in particular at a ratio of 400 $\mu$m to 200 $\mu$m. Hence a single-ply screening fabric, which is similar, for example, to a stocking fabric, can be used to advantage.

In an alternative configuration, the screening fabric is made of thermosetting plastics, natural yarns, metal or a glass fabric. It is thus possible, for example, to produce a particularly durable screening fabric or a soft or hard surface for a screening fabric.

In a particular further configuration, the filter element has a dark color, in particular black or anthracite, at least on the outside. Because the contaminants held back by the filter element are mostly light in color, they can be seen by the user with particular ease and speed on the dark outside of the filter element, reminding the user in an advantageous manner to clean the filter element.

In a further configuration of the present invention, the filter element is adapted to be fastened to the appliance housing by a fastener means which engages the filter element's outer edge surrounding the air entrance opening.

Because the filter element is customarily comprised of a material that is not self-supporting in shape stable in itself, in particular of a screening fabric, a perforated foil or the like, and which fastens only poorly to the appliance housing without fastener, the filter element is fastened to the appliance housing advantageously by a separate fastener. Thus, the fastener which engages in particular the outer edge of the filter element does not reduce the area of cross-section of the air entrance opening and accordingly does not obstruct the flow of air through the appliance. The fastener itself is configured as a clamping ring and/or carrier element which is shaped in particular as a carrier grille. This results in the advantage of enabling the filter element to be fastened to the appliance housing by just a clamping ring or a carrier element, particularly a carrier grille. It is also possible, however, for the filter element to be fixed by a clamping ring and a carrier grille, in which arrangement these parts combine to form a filter device. This is particularly advantageous because the carrier grille is on the inside of the filter element and the filter element is thus supported by the carrier grille.

In another further configuration, the screening fabric is held between the clamping ring and the carrier element, particularly the carrier grille. It is thus possible advantageously to also replace just the screening fabric and to insert and mount a new screening fabric between the clamping ring and carrier grille.

In a further configuration of the present invention, the screening fabric is stretched over the carrier element, in particular over the outside of the carrier grille, and is fastened at its outer edge by the clamping ring. Simple and effective fastening of the screening fabric is thus proposed, enabling a taut fit of the screening fabric over the carrier grille and a secure attachment of the fabric at its outer edge between the clamping ring and the carrier grille.

In a further configuration of the present invention, the clamping ring and/or the carrier grille include a latch element which is configured in particular as a bayonet catch, latching hooks, latching lugs or similar means and which are provided for effecting a releasable connection with the appliance housing. Simple fastening of the filter device to an appliance housing, for example, a hair dryer, is thus possible and the filter device can also be easily removed again from the appliance housing by the user. This is an advantage to the user, for example, for wet cleaning or when replacing a defective filter element.

In another further configuration, the clamping ring and/or the carrier grille are fabricated from a plastic material and are non-releasably connected with the screening fabric, for example, by clipping, welding, injection-molding or the like. In particular it is proposed casting the screening fabric with the clamping ring and the carrier grille, thus enabling a solid, durable filter device unit.

In a particularly advantageous further configuration of the present invention, the open area of the filter element enabling the passage of air amounts to 30% to 60%, approximately, of the total area of the filter element impacted by the air current, and the fabric threads or segments of the perforated foil have a thread thickness or segment width smaller than or equal to 400 $\mu$m. Hence the requisite volumetric rate of airflow through the appliance, particularly a hair dryer, is selected sufficiently large to prevent the hair dryer from overheating. At the same time, the thread thickness or segment width indicates a mesh size of the filter element able to retain fluff and hair effectively; by contrast, minutest dust particles can pass through the filter element and flow through the hair dryer.

In a particular further configuration of a filter device of the present invention, which may also be presented as an independent invention, it is proposed for the filter element to be comprised of a perforated foil having essentially the same functional and structural features as described in the foregoing, for example, hole size and surface structure, as well as free access to the outside of the filter. The same advantages apply essentially to such a filter element made of a perforated foil as for the screening fabric previously described in detail. However, it is particularly advantageous for a perforated foil to be made of metal because metal is particularly well suited for the quantity production of perforated foils using, for example, an etching or photoresist process.

In a particularly advantageous feature of the present invention, a filter device incorporating the previously mentioned features is releasably connected with an electrically powered hair-care appliance, particularly a hair dryer, a hot-air curling brush or the like. Hence it is possible for a filter device of this type to be fastened to a hair dryer and easily detached again, for example, for cleaning or replacement purposes.

As an alternative to this feature, it is proposed connecting a filter device of the present invention integrally with a hair-care appliance, in particular a hair dryer. This thus provides advantageously a filter device which is connected permanently with a hair dryer and is therefore successful in protecting the hair dryer throughout its useful life in that it reliably prevents undesired contaminants, for example, hair or fluff, dust or the like, from getting into the interior of the hair dryer.

In a further advantageous feature of the present invention, which may be equally presented as an independent invention, a method of cleaning a filter device of the type referred to in the foregoing is proposed. With this method, the presence of contaminants deposited on the outside of the filter element is indicated to the user in particular by the contrast of color between the outside of the filter element and the contaminants themselves promptly after they are deposited. In a particularly advantageous manner, the user is thus given a visual warning of a soiled condition at the earliest possible moment. As a result of the filter element's surface structure as disclosed in the present invention, the user will then remove the contaminants simply by wiping over the outside of the filter element. Advantageously, the contaminants can be removed by the user without an additional tool, for example, the user can perform the wiping action with his bare hand, in particular with the fingers of one hand.

Further features, advantages and application possibilities of the present invention will become apparent from the subsequent description of embodiments illustrated in more detail in the accompanying drawings. It will be understood that any single feature and any combination of single features described and/or represented by illustration form the subject-matter of the present invention, irrespective of their summary in the claims and their back reference.

DETAILED DESCRIPTION OF THE DRAWINGS

Figure 1:
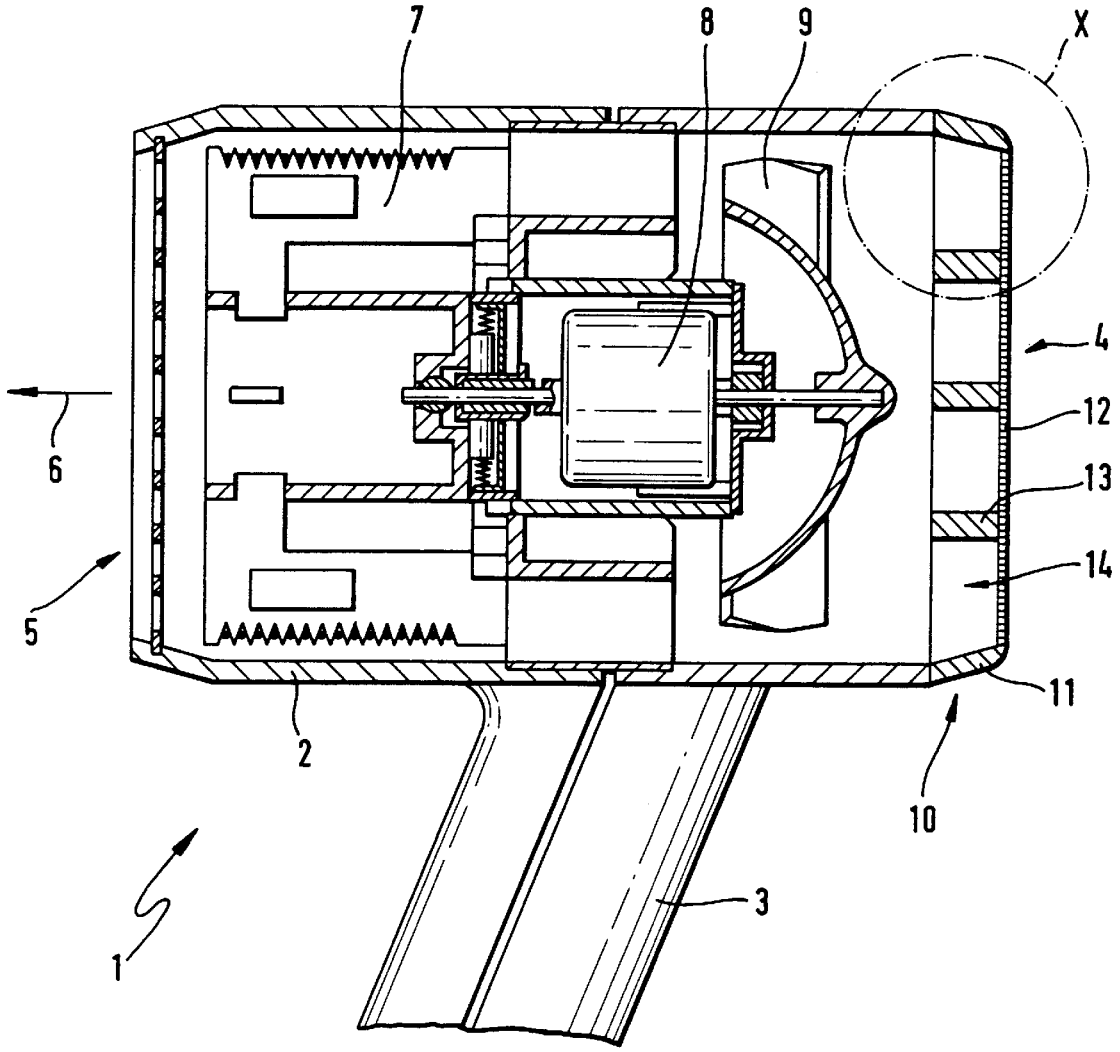
FIG. 1 is a schematic, longitudinal sectional view of a hair dryer with a filter device constructed in accordance with the present invention.

A hair dryer 1 (FIG. 1) is comprised essentially of a cylindrical housing 2 and a handle section 3 provided thereon. The housing 2 is provided with an air entrance opening 4 and an air exit opening 5 of a conventionally round cross-section of aperture, and a current of air generated in the interior of the hair dryer is caused to flow through the housing essentially in the main direction of flow 6. A heating device 7 and a motor 8 for driving a fan impeller 9 are provided in the housing 2. Attached to the air entrance opening 4 is further a filter device 10 which is formed by a carrier grille 11 and a filter element 12 which may be configured as a screening fabric or also as a perforated foil. The carrier grille 11 includes several grille bars 13, one compartment each being formed between various grille bars 13.

Figure 2:
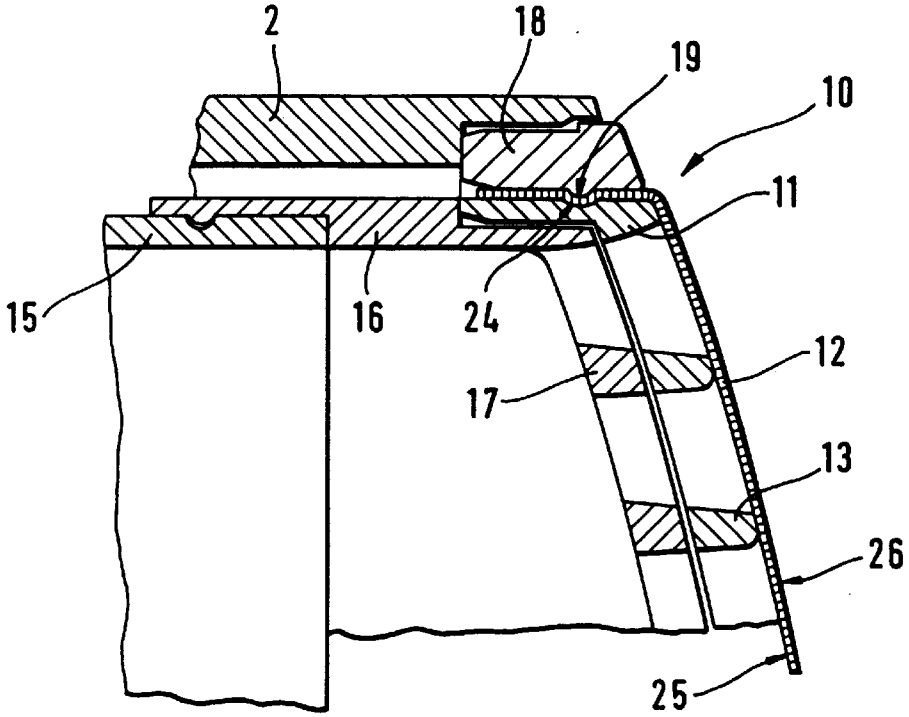
FIG. 2 is a sectional view of a detail of a filter device similar to detail X of FIG. 1.

Provision is made in a hair dryer housing 2 (FIG. 2) for a heating tube 15 bounded at its air entrance end by an air entrance grille 16 having grille bars 17. A filter device 10 of the present invention comprises a carrier grille 11 with grille bars 13, in which the grille pattern of the carrier grille 11 coincides substantially with the grille pattern of the air entrance grille 16. A filter element, for example, a screening fabric or also a perforated foil, is provided on the outside of the carrier grille 11 and is stretched over the grille bars 13 and held by a clamping ring 18 against the outer lying surfaces of the carrier grille 11 when viewed in a circumferential direction. To fasten a filter element 12 between the carrier grille 11 and the clamping ring 18 in a way that enables the filter element to be replaced, the outside of the carrier grille 11 is provided, for example, with a circumferential groove 24 in which a circumferential lug 19 of the clamping ring 18 is received by locking engagement therewith. The filter element 12 is thus fixed in place by the lug 19 engaging within the groove 24.

Figure 3:
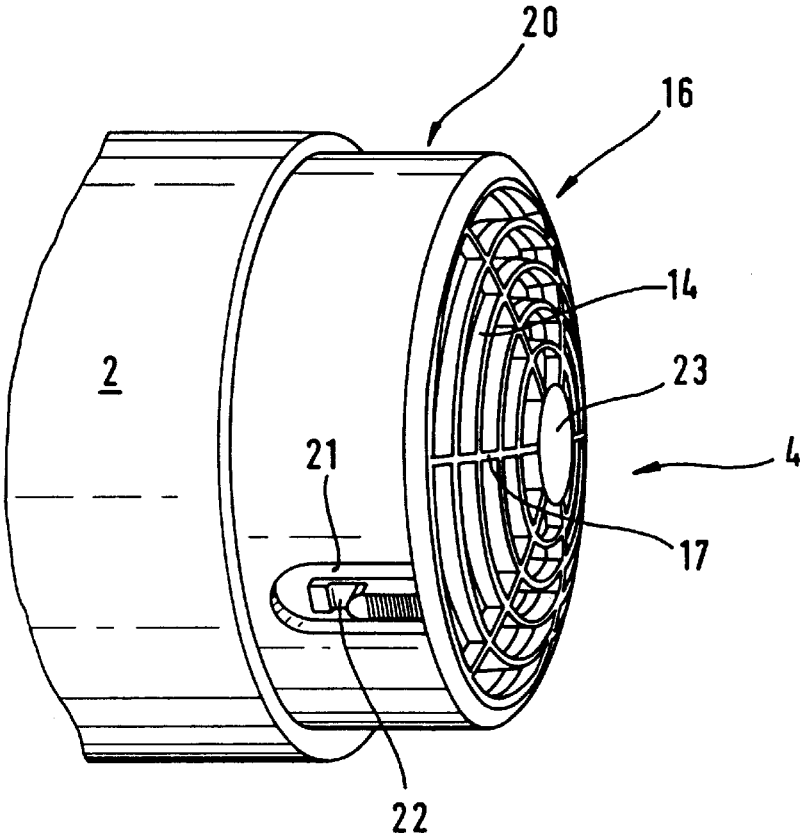
FIG. 3 is a perspective view of an air entrance end of a hair dryer.

The air entrance end of a housing 2 for a hair dryer (FIG. 3) is equipped with an annular surface 20 on which a filter device according to the present invention can be mounted and fastened. To fasten a filter device provision is made, for example, for a latch 22 which is arranged in an opening 21 and has its one end freely movably mounted so it can snap into a corresponding opening of the filter device. In the air entrance opening 4 of the housing 2 provision is made for an air entrance grille 16 having grille bars 17 extending as star-shaped radial bars in concentrically arranged rings. These grille bars 17 and rings form separate compartments 14 through which the current of air flows. A disk 23 is provided at the center of the air entrance grille 16.

In cases where a filter element is configured, for example, as a screening fabric, it can be placed directly on the outside of the air entrance grille 16 and be held against the grille's outer surface by a clamping ring. On the other hand, a filter device comprising the components previously described in FIG. 2, namely a carrier grille, a screening fabric and a clamping ring, can also be connected to the housing 2. As an alternative it is also possible for a central fastening button, not shown, to be provided on the outside of a filter element and be fastened, for example, in the disk 23 in order to thus press a filter element against the outside of the air entrance grille 16.

According to the present invention, the thickness of the filter element is dimensioned so small as to cause contaminants to settle essentially on the outside of the filter element and, particularly as the result of the small thickness, to prevent them from becoming trapped in the filter element.

While the mesh width of the screening fabric lies advantageously between 80 $\mu$m and 1200 $\mu$m, and the thread diameter between 55 $\mu$m and 400 $\mu$m, the dimensions are particularly those mentioned in the subsequent embodiment, resulting further in the aforementioned ratios of mesh width to thread diameter.

A particularly preferred configuration of a filter device of the present invention is equipped with a screening fabric made of polyester (PES) having a mesh width to thread diameter ratio of 400 $\mu$m to 200 $\mu$m and an open area enabling the passage of air of 44%. The fabric is 370 $\mu$m thick, which means that the surface structure, particularly the surface roughness, of the fabric is of such condition that contaminants such as, for example, hair or fluff, held back by the filter element and adhering to the outside of the filter element are visually easy to identify by the user and can be removed readily from the outside of the filter using a simple wiping motion without major effort and also without an additional tool.

As an alternative to this filter element made of screening fabric, it is also possible to use a perforated foil, the segments of such a perforated. foil preferably having a width greater than or equal to 180 $\mu$m and the foil a thickness smaller than or equal to 600 $\mu$m.

We claim:

1. A filter device for an air-moving hair-care appliance having a housing defining an air discharge opening and an air entrance opening and having a marginal region surrounding said air entrance opening, comprising a flexible filter element having an inner and an outer side and a peripheral securement edge, wherein the filter element is of small thickness, the filter element being single-ply and having a mesh width of less than 500 $\mu$m, and a fastener adapted to retain the filter element securement edge proximate the air-moving appliance housing at a location adjacent the marginal region surrounding the air entrance opening, said fastener not extending across laterally opposed portions of the filter element outer side so that a user accesses the filter element outer side unobstructed in a region of an outwardly directed projection of the outer side, whereby when the filter element securement edge is retained adjacent the marginal region of the air entrance opening, the inner side of the filter element is in register with the air entrance opening of the air-moving appliance, and undesired particulate matter is deposited on the outer side of the filter element substantially accessible to the user, wherein the filter element comprises a fabric, said fabric having a mesh width to thread diameter ratio of between about 1.45:1 and about 3:1.

2. The filter device as claimed in claim 1, wherein the fabric comprises a thermoplastic material selected from the group consisting of polypropylene, polyacrylics and polyester.

3. The filter device as claimed in claim 1, wherein the fabric comprises a material selected from the group consisting of thermosetting plastics, natural yarns, metal and glass fabric.

4. The filter device as claimed in claim 1, wherein the filter element further comprises a first color, whereby the particulate matter of a contrasting color deposited on the filter element outer side is visible to the user.

5. The filter device as claimed in claim 1, wherein the fastener further comprises a clamping ring.

6. The filter device as claimed in claim 1, wherein the fastener further comprises a carrier grille proximal the filter element inner side.

7. The filter device as claimed in claim 6, wherein the fastener further comprises a clamping ring positioning the filter element to the carrier grille.

8. The filter device as claimed in claim 6, wherein the carrier grille further comprises a grille body and the fastener further comprises a clamping ring, whereby the clamping ring retains the filter element securement edge to the grille body.

9. The filter device as claimed in claim 1, wherein the fastener further includes a releasable latch element selected from the group consisting of a bayonet catch, latching hooks, and latching lugs.

10. The filter device as claimed in claim 7, wherein the clamping ring and the carrier grille are fixedly connected with the filter element.

11. A filter device for an air-moving hair-care appliance having a housing defining an air discharge opening and an air entrance opening and having a marginal region surrounding said air entrance opening, comprising a flexible filter element having an inner and an outer side and a peripheral securement edge, wherein the filter element is of small thickness, the filter element being single-ply and having a mesh width of less than 500 $\mu$m, and a fastener adapted to retain the filter element securement edge proximate the air-moving appliance housing at a location adjacent the marginal region surrounding the air entrance opening, said fastener not extending across laterally opposed portions of the filter element outer side so that a user accesses the filter element outer side unobstructred in a region of an outwardly directed projection of the outer side, whereby when the filter element securement edge is retained adjacent the marginal region of the air entrance opening, the inner side of the filter element is in register with the air entrance opening of the air-moving appliance, and undesired particulate matter is deposited on the outer side of the filter element substantially accessible to the user, and wherein a first portion of the filter element outer side has a first surface area and the filter element within said first portion has a mesh width defining a plurality of air passage apertures whose aggregate surface area is between about 30% and about 60% of said first portion surface area of the outer side.

12. A filter device for an air-moving hair-care appliance having a housing defining an air discharge opening and an air entrance opening and having a marginal region surrounding said air entrance opening, comprising a filter element having an inner and an outer side and a peripheral securement edge, wherein the filter element comprises a perforated foil of small thickness, the filter element being single-ply and wherein a first portion of the filter element outer side has a first surface area and the filter element within said first portion has a mesh width defining a plurality of air passage apertures whose aggregate surface area is between about 30% and about 60% of said first portion surface area of the outer side, and a fastener adapted to retain the filter element securement edge proximate the air-moving appliance housing at a location adjacent the marginal region surrounding the air entrance opening, said fastener not extending across laterally opposed portions of the filter element outer side so that a user accesses the filter element outer side unobstructed in a region of an outwardly directed projection of the outer side, whereby when the filter element securement edge is retained adjacent the marginal region of the air entrance opening, the inner side of the filter element is in register with the air entrance opening of the air-moving appliance, and undesired particulate matter is deposited on the outer side of the filter element substantially accessible to the user.

13. The filter device as claimed in claim 12, wherein the perforated foil comprises metal.

14. The filter device as claimed in claim 12, wherein the perforated foil comprises a material selected from the group consisting of a plastic material and a glass fabric.

15. The filter device as claimed in claim 12 wherein the perforated foil has a thickness not greater than 600 $\mu$m.

16. The filter device of claim 1 in combination with the air-moving hair-care appliance.

17. The filter device of claim 1 integrally formed with the air-moving hair-care appliance.

18. The filter device as claimed in claim 1, wherein the fastener releasably retains the filter element.

19. The filter device as claimed in claim 1, wherein the filter element is secured by the fastener only at the location adjacent the marginal region surrounding the air entrance opening.

20. The filter device as claimed in claim 1, wherein the filter element fabric comprises threads having a generally round cross-section.

21. The filter device as claimed in claim 1, wherein said ratio is about 2:1.

22. The filter device as claimed in claim 1, wherein said mesh width is at least about 80 $\mu$m.

23. The filter device as claimed in claim 1, wherein said thread diameter is between about 55 $\mu$m and about 400 $\mu$m.

24. The filter device as claimed in claim 4, wherein the first color is selected from the group of colors consisting of black and anthracite.

25. The filter device as claimed in claim 8, wherein the clamping ring releasably retains the filter element to the carrier grille.

26. The filter device as claimed in claim 10 wherein the filter element is fixedly connected by an assembly process selected from the group of processes consisting of clipping, welding, injection-molding and casting.

27. The filter device as claimed in claim 11, wherein the filter element further comprises fabric having threads having a diameter not greater than about 400 $\mu$m.

28. The filter device as claimed in claim 27, wherein the mesh width is about 400 $\mu$m and the thread diameter is about 200 $\mu$m, whereby the air passage apertures aggregate surface area is about 44% of the first portion surface area.

29. The filter device as claimed in claim 28 wherein the fabric thickness is 370 $\mu$m.

30. The filter device as claimed in claim 12, wherein the perforated foil further comprises segments having a generally round cross-section.

31. The filter device as claimed in claim 13, wherein the perforated foil comprises perforations formed by a process selected from the group consisting of etching and photoresist.

32. The filter device as claimed in claim 12, wherein the perforated foil mesh further comprises interconnected segments having width not greater than 400 $\mu$m.

33. The filter device as claimed in claim 12, wherein the fastener further comprises a clamping ring.

34. The filter device as claimed in claim 12, wherein the fastener further comprises a carrier grille proximal the filter element inner side.

35. The filter device as claimed in claim 34, wherein the fastener further comprises a clamping ring positioning the filter element to the carrier grille.

36. The filter device of claim 12 in combination with the air-moving hair-care appliance.

37. The filter device of claim 12 integrally formed with the air-moving hair-care appliance.

38. A filter for an air-moving appliance, said air-moving appliance having a housing defining an air discharge opening and an air inlet opening and having a marginal region surrounding said air inlet opening, comprising a filter element having an inner side and an outer side and a securement region at a peripheral edge between said inner and outer sides, wherein a first portion of said filter element outer side has a first surface area and said filter element within said first portion further comprises a mesh having mesh width of between about 80 μm and about 1200 μm formed by interconnected threads defining a plurality of air passage apertures whose aggregate surface area is between about 30% and about 60% of said outer side first portion surface area, the filter element mesh being single-ply and having a mesh width to thread diameter ratio between about 1.45:1 and 3:1, and said securement region adapted to be retained to the air-moving appliance at a location adjacent the marginal region surrounding the air inlet opening, whereby when said inner side of said filter element is retained in register with the air inlet opening, undesired particulate matter is deposited on the outer side of the filter element accessible to the user.

39. The filter of claim 38, wherein the filter element comprises a fabric having thread segments having a diameter not greater than about 400 μm.

40. The filter of claim 39, wherein the fabric thickness is 370 μm.

41. The filter of claim 38 further comprising a fastener retaining said filter element securement region adjacent the marginal region surrounding the air inlet opening.

42. The filter of claim 41, wherein said fastener does not extend across laterally opposed portions of the filter element outer side, so that in a region of an outwardly directed projection of the outer side a user can unobstructedly access the filter element outer side.

43. The filter of claim 42, wherein the fastener further comprises a clamping ring.

44. The filter of claim 42, wherein the fastener further comprises a carrier grille proximal the filter element inner side.

45. The filter of claim 44, wherein the fastener further comprises a clamping ring positioning the filter element to the carrier grille.

46. The filter of claim 38 in combination with the air-moving appliance.

47. The filter device as claimed in claim 1, wherein said mesh width is not greater than about 400 μm.

48. The filter device as claimed in claim 21, wherein said mesh width is about 400 μm.

49. The filter device as claimed in claim 29, wherein the fabric further comprises polyester.

50. The filter device as claimed in claim 1, wherein the fabric comprises a non-hygroscopic material.

51. The filter of claim 38, wherein the securement region is adapted to be secured to the air-moving appliance only at the location adjacent the marginal region surrounding the air inlet opening.

52. The filter of claim 38, wherein said ratio is about 2:1.

53. The filter of claim 38, wherein the securement region does not obstruct the filter element outer side in a region of an outwardly directed projection of the outer side in register with the air inlet.

54. A filter device releasably attachable to an air-moving hair-care appliance having a housing defining an air discharge opening and an air entrance opening and having a marginal region surrounding said air entrance opening, said releasable filter device comprising a filter element having an inner and an outer side and a peripheral securement edge, and a fastener having a latch element adapted to releasably retain the filter element securement edge proximate the air-moving appliance housing at a location adjacent the marginal region surrounding the air entrance opening, said fastener not extending across laterally opposed portions of the filter element outer side so that a user accesses the filter element outer side unobstructed in a region of an outwardly directed projection of the outer side, said fastener further comprising a carrier grille proximal the filter element inner side and supporting the filter element, and a clamping ring positioning the filter element to the carrier grille, whereby the filter device is releasable as a unit, whereby when the filter element securement edge is retained adjacent the marginal region of the air entrance opening, the inner side of the filter element is in register with the air entrance opening of the air-moving appliance, and undesired particulate matter is deposited on the outer side of the filter element substantially accessible to the user.

55. The filter device as claimed in claim 54, wherein the clamping ring positions the filter element to the carrier grille at least partially between the clamping ring and the carrier grille.

56. The filter device as claimed in claim 54, wherein the clamping ring has a first locking element and the carrier grille has a second locking element adapted for interfitting engagement with the first locking element.

57. The filter device as claimed in claim 54, wherein the clamping ring and the carrier grille are fixedly connected with the filter element.

58. The filter device as claimed in claim 54, wherein the filter element is single-ply.

59. The filter device as claimed in claim 54, wherein a first portion of the filter element outer side has a first surface area and the filter element within said first portion has a mesh width defining a plurality of air passage apertures whose aggregate surface area is between about 30% and about 60% of said first portion surface area of the outer side.

60. The filter device as claimed in claim 54, wherein the filter element comprises a fabric.

61. The filter device of claim 60, wherein the filter element has a mesh width to thread diameter ratio of between about 1.45:1 and about 3:1.

62. The filter device of claim 61, wherein the mesh width is between about 80 μm and 1200 μm.

63. The filter device of claim 60, wherein a fabric thickness is 370 μm.

64. The filter device of claim 54, wherein the filter element mesh comprises interconnected segments having width not greater than 400 μm.

65. The filter device of claim 54 wherein the filter element is secured by the fastener only at the location adjacent the marginal region surrounding the air entrance opening.

66. The filter device of claim 54 in combination with the air-moving appliance.

67. The filter of claim 54, wherein the filter element comprises a perforated foil having segments having width between 180 μm and 400 μm inclusive, said foil thickness being not greater than 600 μm.

68. A method of cleaning a filter device for an air-moving hair-care appliance having an air discharge opening and an air inlet opening and having a marginal region surrounding said air inlet opening, comprising the steps of providing a single-ply, flexible filter element of small thickness having an inner and an outer side and a securement region at a peripheral edge between said inner and outer sides, wherein a first portion of said filter element outer side has a first surface area and said filter element within said first portion further comprises a mesh width defining a plurality of air passage apertures whose aggregate surface area is between about 30% and about 60% of said outer side first portion surface area, said filter element having a mesh width of less than 500 μm, retaining said filter element securement edge only at a location adjacent the marginal region of the air inlet opening, whereby said filter element inner side is in register with the air inlet opening and presents to a user the filter element outer side unobstructed in a region of an outwardly directed projection of the outer side, depositing, during air-moving operation of the appliance by the user, undesired particulate matter on said outer side unobstructed region of the filter element, and wiping said outer side unobstructed region of the filter element by the user, whereby the undesired particulate matter is substantially removed.

69. The method as claimed in claim 68, wherein the wiping step further comprises the particulate matter being removed by the user without an additional tool.

70. The method as claimed in claim 68 wherein the wiping step further comprises wiping said outer side with a user's unaided hand.

71. The method as claimed in claim 68 wherein the step of providing further comprises the filter element comprising a first color, and the step of depositing further comprises the step of visibly indicating to the user a presence of deposited particulate matter of a color contrasting to the first color.

* * * * *